US007712166B2

(12) United States Patent
Stryker et al.

(10) Patent No.: US 7,712,166 B2
(45) Date of Patent: May 11, 2010

(54) BED SIDERAIL AND SUPPORT STRUCTURE

(75) Inventors: Martin W. Stryker, Kalamazoo, MI (US); Jeffrey L. Lewandowski, Delton, MI (US); Dhiraj Tiwari, Kalamazoo, MI (US)

(73) Assignee: Stryker Corporation, Kalamazoo, MI (US)

( * ) Notice: Subject to any disclaimer, the term of this patent is extended or adjusted under 35 U.S.C. 154(b) by 385 days.

(21) Appl. No.: 11/290,739

(22) Filed: Nov. 30, 2005

(65) Prior Publication Data

US 2006/0117481 A1 Jun. 8, 2006

Related U.S. Application Data

(60) Provisional application No. 60/633,397, filed on Dec. 3, 2004.

(51) Int. Cl.
*A47C 21/08* (2006.01)

(52) U.S. Cl. ..... 5/430; 5/425; 5/428

(58) Field of Classification Search ..... 5/424–430, 5/663

See application file for complete search history.

(56) References Cited

U.S. PATENT DOCUMENTS

| | | | | |
|---|---|---|---|---|
| 3,012,255 | A | 12/1961 | Diehl | |
| 3,336,609 | A | 8/1967 | Taylor | |
| 3,585,659 | A * | 6/1971 | Burst et al. | 5/430 |
| 3,840,917 | A | 10/1974 | Taylor | |
| 3,930,273 | A | 1/1976 | Stern | |
| 4,509,217 | A | 4/1985 | Therrien | |
| 4,987,623 | A | 1/1991 | Stryker et al. | |
| 5,187,824 | A | 2/1993 | Stryker | |
| 5,216,768 | A | 6/1993 | Bodine et al. | |
| 5,279,010 | A | 1/1994 | Ferrand et al. | |
| 5,394,580 | A | 3/1995 | Foster et al. | |
| 5,604,942 | A | 2/1997 | Allevato et al. | |
| 5,689,839 | A | 11/1997 | Laganiere et al. | |
| 6,360,385 | B1 | 3/2002 | Lewandowski | |
| 6,363,552 | B1 | 4/2002 | Hornbach et al. | |

(Continued)

OTHER PUBLICATIONS

Medical Electrical Equipment, Part 2: Particular requirements for the safety of electrically operated hospital beds, International Electrotechnical Commission, CEI IEC 601-2-38, First Edition 1996 (pp. 1-69).

(Continued)

*Primary Examiner*—Fredrick Conley
(74) *Attorney, Agent, or Firm*—Van Dyke, Gardner, Linn & Burkhart, LLP

(57) ABSTRACT

A siderail and support mechanism for a bed includes a siderail having a head edge and a foot edge. First and second support arms having upper and lower pivot shafts are configured to pivotally attach the siderail to a bed. At least one of the first support arm and the second support arm includes an edge configured to form a continuous face with one of the head edge and the foot edge of the siderail. In a further embodiment, a bed siderail and support mechanism includes a siderail for a bed including a central portion and at least one end portion. The end portion is configured to extend lower than the central portion to closely cooperate with a bed structure for preventing a patient from being trapped between the siderail and the bed. The siderails are configured to minimize potential trapping hazards.

22 Claims, 8 Drawing Sheets

U.S. PATENT DOCUMENTS

| | | | | |
|---|---|---|---|---|
| 6,401,277 | B1 * | 6/2002 | Savage et al. | 5/430 |
| 6,564,404 | B1 * | 5/2003 | Nanahara | 5/430 |
| 6,640,360 | B2 | 11/2003 | Hornbach et al. | |
| 6,658,680 | B2 | 12/2003 | Osborne et al. | |
| 6,691,345 | B2 | 2/2004 | Nanahara | |
| D488,941 | S | 4/2004 | Lemire et al. | |
| D488,942 | S | 4/2004 | Lemire et al. | |
| 6,721,975 | B1 | 4/2004 | Lemire | |
| 6,938,289 | B2 | 9/2005 | Morin | |
| 6,951,036 | B2 | 10/2005 | Lemire | |
| 7,028,352 | B2 * | 4/2006 | Kramer et al. | 5/425 |
| 7,073,219 | B2 | 7/2006 | Poulin et al. | |
| 7,073,220 | B2 | 7/2006 | Simmonds et al. | |
| 7,082,630 | B2 | 8/2006 | Castonguay et al. | |
| 7,107,637 | B2 | 9/2006 | Kuek et al. | |
| 7,237,288 | B2 | 7/2007 | Lemire et al. | |
| 2003/0167568 | A1 | 9/2003 | Brooke | |
| 2004/0040092 | A1 | 3/2004 | Hensley et al. | |
| 2005/0160527 | A1 | 7/2005 | Morin | |
| 2005/0166322 | A1 | 8/2005 | Kramer et al. | |
| 2006/0053555 | A1 | 3/2006 | Poulos et al. | |
| 2006/0059621 | A1 | 3/2006 | Poulos et al. | |
| 2006/0059624 | A1 | 3/2006 | Poulos et al. | |
| 2006/0090260 | A1 | 5/2006 | Stryker et al. | |
| 2006/0117481 | A1 | 6/2006 | Stryker et al. | |
| 2006/0137092 | A1 | 6/2006 | Reinke et al. | |
| 2006/0168730 | A1 | 8/2006 | Menkedick et al. | |
| 2006/0168731 | A1 | 8/2006 | Menkedick et al. | |
| 2006/0195984 | A1 | 9/2006 | Hakamiun et al. | |

OTHER PUBLICATIONS

Draft Guidance for Industry and FDA Staff, Hospital Bed System Dimensional Guidance to Reduce Entrapment, U.S. Department of Health and Human Services, Aug. 30, 2004 (pp. 1-32).

Amendment 1, Medical electrical equipment, Part 2-38: Particular requirements for the safety of electrically operated hospital beds, International Standard, IEC 60601-2-38, 1999 (pp. 1-15).

* cited by examiner

BED SIDERAIL AND SUPPORT STRUCTURE

CROSS-REFERENCE TO RELATED APPLICATIONS

This application claims the benefit of U.S. Provisional application Ser. No. 60/633 397, filed Dec. 3, 2004.

FIELD OF THE INVENTION

The invention relates to bed siderails. In one of its aspects, the invention relates to hospital bed siderails configured to reduce pinch points between the siderail and its supporting arms. In another of its aspects, the invention relates to a siderail configured to reduce the likelihood of a patient becoming trapped between the siderail and the bed.

BACKGROUND OF THE INVENTION

Hospital beds are provided with safety siderails. The express purpose of the siderail is to prevent a patient from inadvertently rolling out of the bed. The siderail must be movable, however, in order to permit the patient to exit the bed, or to permit medical attendants to minister to the patient. It is common to provide a four bar link mechanism to the siderail, configured to lower the siderail to a mid-position and to a storage position when not in use.

There is some concern that a patient might trap some portion of their body between the siderail and the bed. There is further concern with trapping some portion of the patient between the siderail and the bed as the siderail is lowered.

It would be advantageous to provide a bed siderail that minimizes the opportunity for part of a patient's body to be wedged between the bed and the siderail. It would further be advantageous to provide a siderail configured to minimize the opportunity for part of a patient's body to be trapped during a lowering operation of the bed siderail.

SUMMARY OF THE INVENTION

A siderail and support mechanism for a bed includes a siderail having a head edge and a foot edge. First and second support arms having upper and lower pivot shafts are configured to pivotally attach the siderail to a bed. At least one of the first support arm and the second support arm includes an edge configured to form a continuous face with one of the head edge and the foot edge of the siderail.

In a further embodiment, a bed siderail and support mechanism includes a siderail for a bed including a central portion and at least one end portion. The end portion is configured to extend lower than the central portion to closely cooperate with a bed structure for preventing a patient from being trapped between the siderail and the bed.

DETAILED DESCRIPTION OF THE INVENTION

Figure 1:
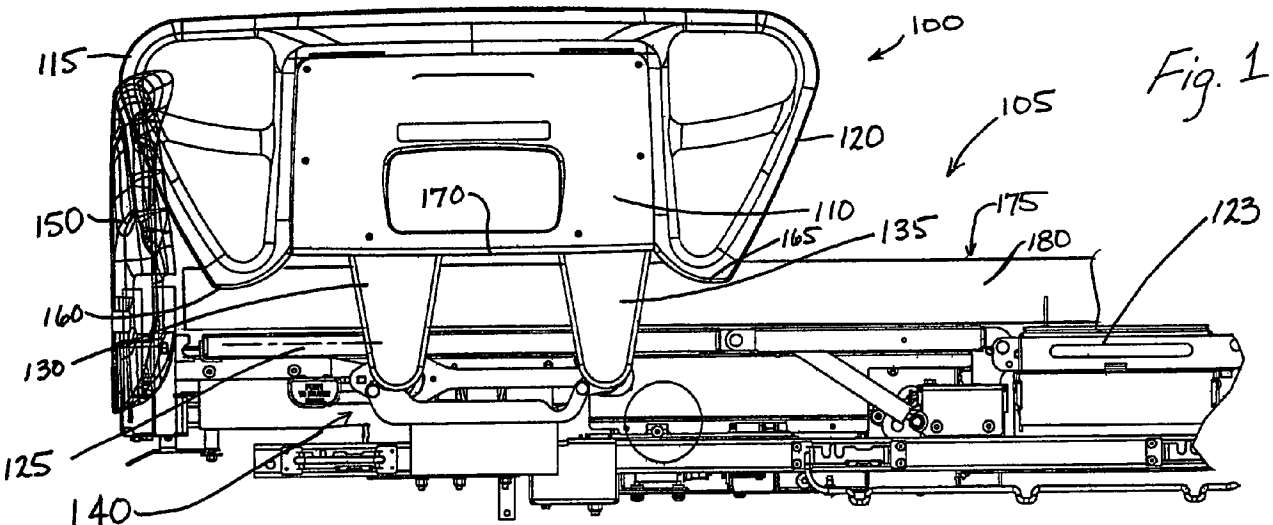
FIG. 1 is a side view of a bed siderail and support structure according to the invention.

Certain terminology will be used in the following description for convenience in reference only and will not be limiting. The words "up", "down", "right" and left" will designate directions in the drawings to which reference is made. The words "in" and "out" will refer to directions toward and away from, respectively, the geometric center of the device and designated parts thereof. The word "longitudinal" will refer to a direction defined between a head end and a foot end of a hospital bed, while "transverse" describes a direction across the width of the hospital bed. Such terminology will include derivatives and words of similar import.

Referring to FIG. 1, a bed siderail 100 according to the invention is illustrated for mounting to a hospital bed 105. The bed siderail 100 includes a central portion 110 and two end portions 115, 120. The bed siderail 100 is pivotally mounted to a bed frame 123 at a bed frame side rail 125 by a pair of support arms 130, 135. The support arms 130, 135 comprise a portion of a four-bar link pivot and locking mechanism 140. An example of a four-bar link pivot and locking mechanism 140 is more fully described in U.S. patent application Ser. No. 10/767,240, entitled "SIDERAIL MOUNTING ASSEMBLY", filed Jan. 28, 2004, which is incorporated herein by reference.

The bed siderail 100 is mounted to the bed frame-side rail 125 proximate an end board 150 (headboard or footboard) of the bed 105. As shown in FIG. 1, the end portion 115 of the bed siderail 100 extends to the end board 150, without any longitudinal gap therebetween.

Figure 2:
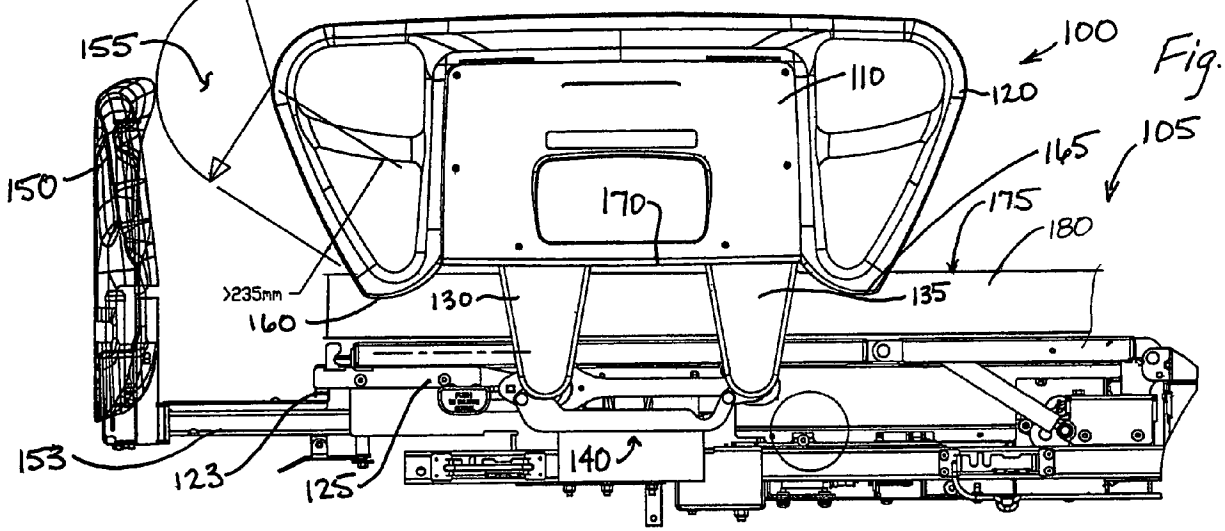
FIG. 2 is a side view of the bed siderail and support structure of FIG. 1, with the bed having an extended bed foot section.

Referring to FIG. 2, the bed frame 123 includes an extension 153. The extension 153 is configured to extend longitudinally from the bed frame 123, moving the end board 150 longitudinally outward from the bed 105 and the bed siderail 100. This is particularly useful with taller patients, when additional clearance is required for medical appliances, or to provide access room for medical personnel.

The extension of the end board 150 creates a gap 155. The bed frame 123 is configured to extend the end board 150 so that the gap 155 is too large for any part of the patient, such as a limb or head, to become trapped. A minimum spacing of 235 millimeters is recommended.

Each end portion 115, 120 of the bed siderail 100 includes a depending lower edge 160, 165. The lower edge 160, 165 extends downwardly, below a lower edge 170 of the central portion 110 of the bed siderail 100. The lower edge 160, 165 of each end portion 115, 120 is configured to extend past an upper surface 175 of a mattress 180 supported by the bed frame 123, creating no gap therebetween.

Figure 3:
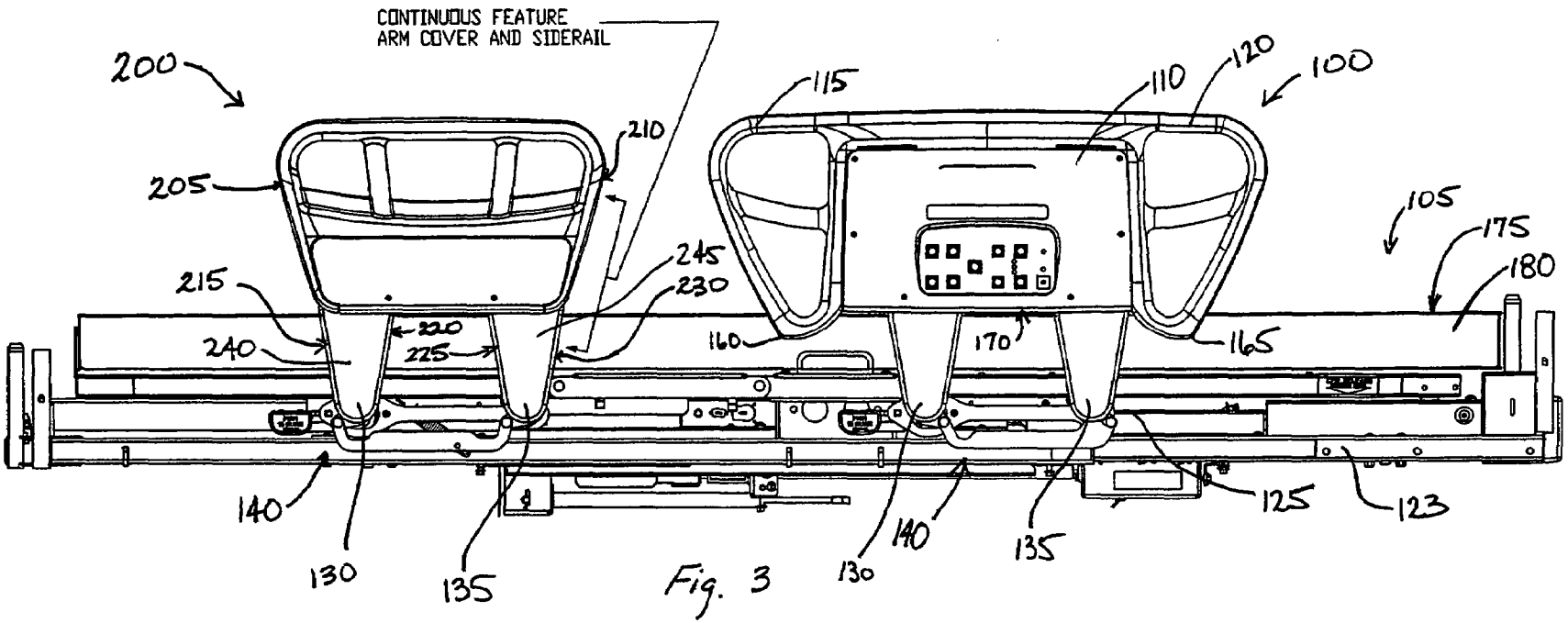
FIG. 3 is a side view of a bed having a second bed siderail according to a further embodiment of the invention.

As shown in FIG. 3, the lower edge 160 of the end portion 115 is further configured to cooperate with a mattress support 185 (or patient restraint anchor). The lower edge 160 of the end portion 115 and the mattress support 185 provide rigid structure to reduce the gap and prevent a patient's limb from passing between the bed siderail 100 and the bed frame 123.

A further embodiment of a bed siderail 200 is disclosed in FIG. 3. The bed siderail 200 is formed with upwardly and outwardly directed head and foot edges 205, 210. The bed siderail 200 is thereby substantially trapezoidal in elevation. The bed siderail 200 is connected to the bed frame 123 in the same manner as the bed siderail 100, wherein the support arms 130, 135 are pivotally connected to each of the bed siderail 200 and the bed frame side rail 125.

The support arms 130, 135 are configured with upwardly and outwardly sloping side surfaces 215, 220, 225, 230, making them appear wedge- or pie-shaped. As shown in FIG. 3, when the bed siderail 200 is in the upright, deployed position, the outer side surfaces 215, 230 of the support arms 130, 135 form a continuous face with the head and foot edges 205, 210 of the bed siderail 210. This formation of the support arms 130, 135 in cooperation with the bed siderail 200 serves to eliminate any gap or recess formed between the bed frame 123 and the bed siderail 200 adjacent to the outer side surfaces 215, 230 of the support arms 130, 135. The outwardly sloping side surfaces 215-230 of the support arms 130, 135 are formed in molded support arm covers 240, 245 attached to the support arms 130, 135, but it is also anticipated that the side surfaces 215-230 can be integrally formed in the support arms 130, 135.

Referring now to FIGS. 4-9, a further embodiment of a bed siderail and support structure 300 is illustrated mounted to the hospital bed 105. Hospital bed 105 is shown in FIGS. 4-7 and 9 having a footboard 305 and a headboard 310. A foot end siderail 315 is pivotally attached to the bed frame side rail 125 by a pair of support arms 320 and a pivot and locking mechanism 140 as described above. A head end siderail 325 is likewise pivotally attached to the bed frame side rail 125 by a pair of support arms 320 and a pivot and locking mechanism 140.

Figure 4:
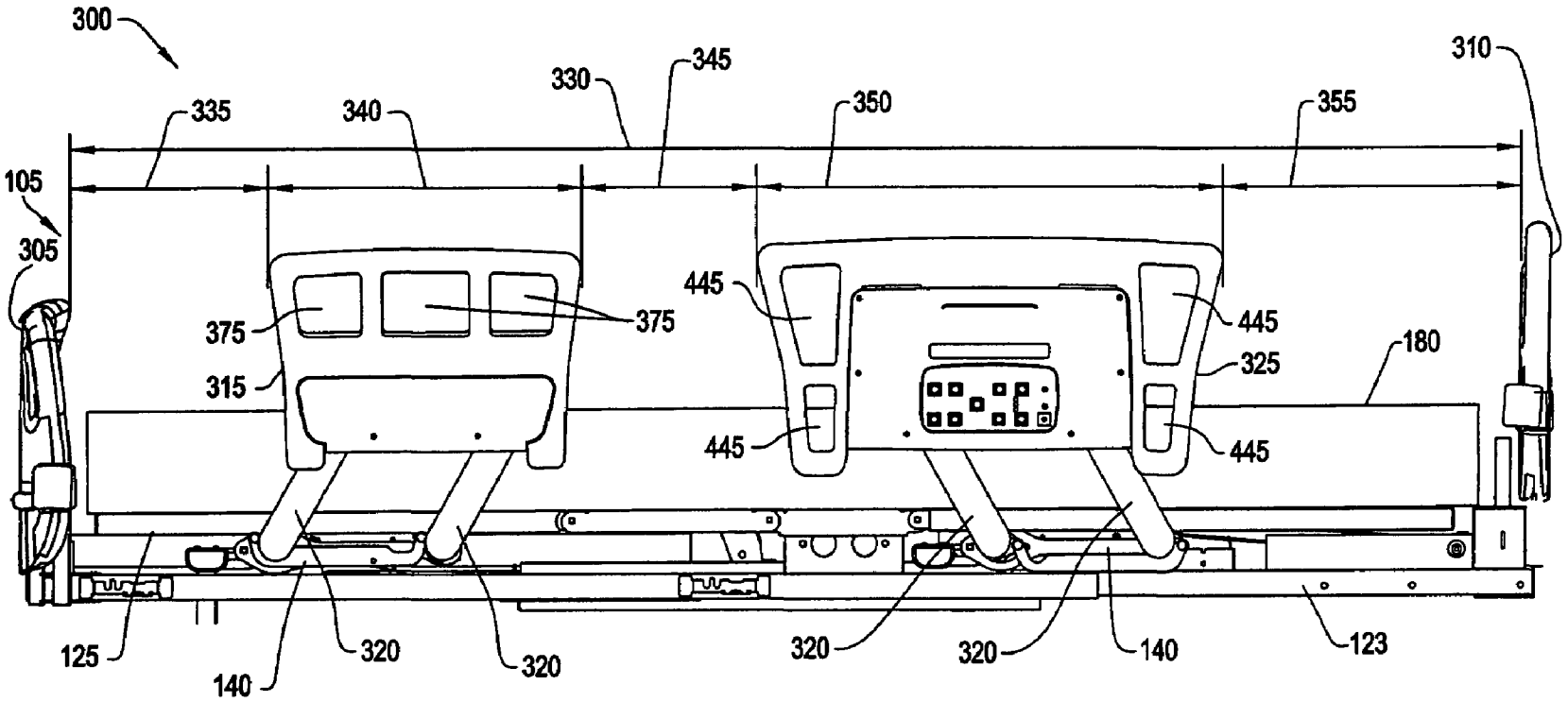
FIG. 4 is a side view of head and foot end bed siderails and support structure according to a further embodiment of the invention.

As shown in FIG. 4, the footboard 305 and the headboard 310 are separated by a distance 330. The distance 330 is equal to the sum of a foot end gap 335, the width 340 of the foot end siderail 315, a inter-siderail gap 345, the width 350 of the head end siderail 325 and a head end gap 355. Preferably, the sum of the widths 340, 350 is equal to or greater than one half of the distance 330. It is also preferred, for the purpose of reducing the risk that a patient might become trapped in one of the gaps 335, 345, 355, that each gap be no more than 60 millimeters wide or no less than 235 millimeters wide with the bed 105 in the flat position shown in FIG. 4.

Figure 5:
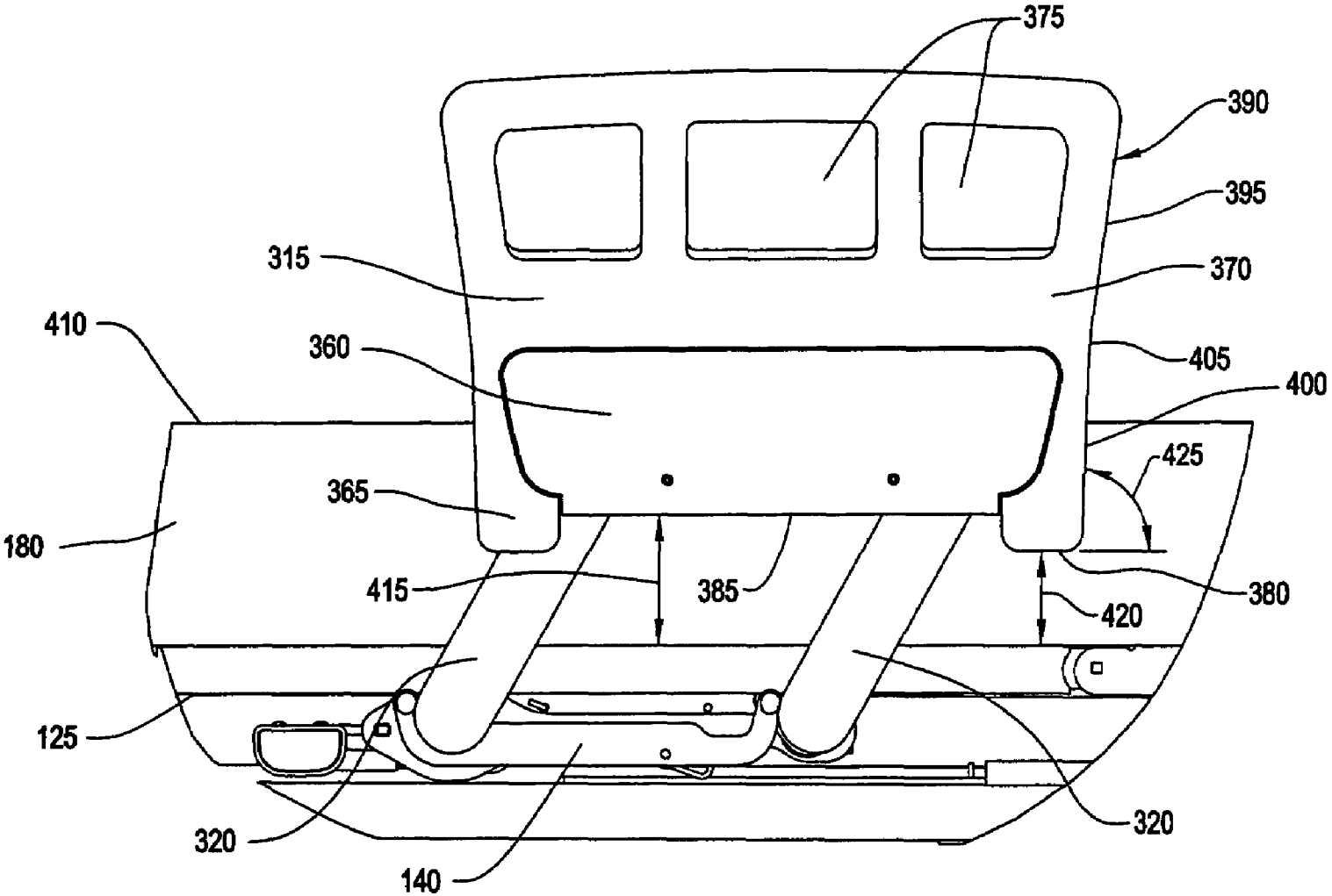
FIG. 5 is a side view of the foot end bed siderail and support structure of FIG. 4.

Referring to FIG. 5, the foot end siderail 315 is shown pivotally mounted to the bed frame side rail 125 by the support arms 320. The foot end siderail 315 includes a central portion 360 and end portions 365, 370. The central portion 360 includes several apertures 375. The apertures 375 are configured to prevent a patient's head from becoming entrapped. Therefore, the apertures are sized to prevent an object having a diameter any greater than 120 millimeters from passing therethrough.

In the illustrated embodiment, the end portions 365, 370 are symmetrical mirror images, but this is not dispositive of other configurations. Referring to the end portion 370, a lower end 380 of the end portion 370 extends lower than a lower extent 385 of the central portion 360. The end portion 370 further includes a siderail end face 390 including an upper end face 395 and a lower end face 400. The upper end face 395 and the lower end face 400 are generally non-collinear, meeting at an intermediate point 405 on the siderail end face 390. The lower end face 400 is configured to be steeper than the upper end face 395, to aid in preventing entrapment. The lower end face 400 preferably forms an angle greater than 60 degrees with the upper surface 175 of the mattress 180.

As shown in FIG. 5, in the raised position the foot end siderail 315 extends above the surface 410 of the mattress 180. In this position, the lower extent 385 of the central portion 360 of the siderail 315 extends a distance 415 above the bed frame side rail 125. The lower end 380 of the end portion 370 extends a smaller distance 420 above the bed frame side rail 125. In a preferred embodiment, the distance 415 is no greater than 120 millimeters, while the distance 420 is no greater than 60 millimeters.

A further entrapment danger must be addressed between the lower end face 400 of the siderail 315 and the mattress 180. To obviate this danger, it is recommended that the lower end face 400 describe an angle 425 with the surface 410 of the mattress 180, the angle 425 preferably being greater than 60 degrees.

Figure 6:
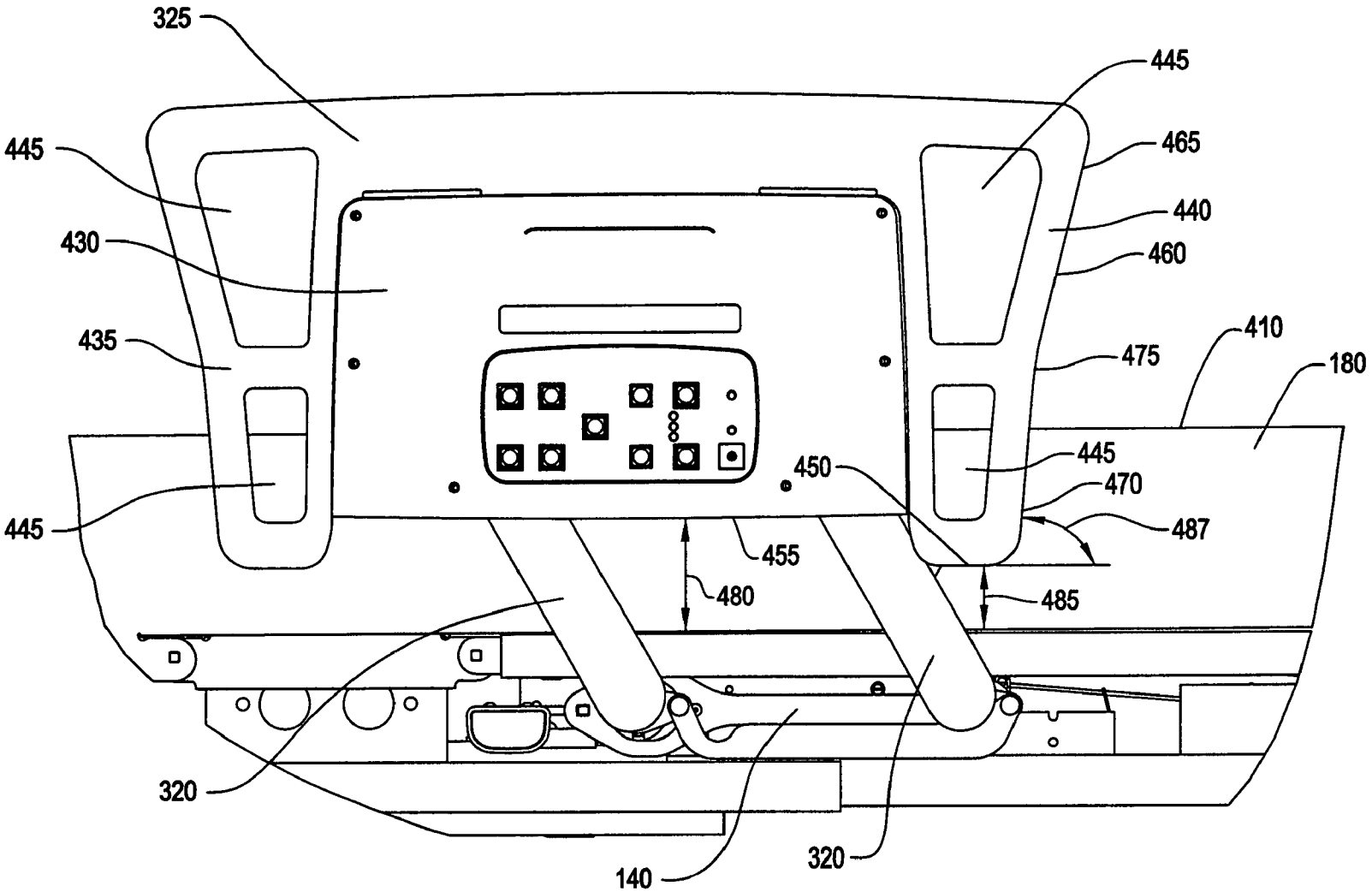
FIG. 6 is a side view of the head end bed siderail and support structure of FIG. 4.

The head end siderail 325 is shown in more detail in FIG. 6. The head end siderail 325 is shown pivotally mounted to the bed frame side rail 125 by the, support arms 320. The head end siderail 325 includes a central portion 430 and end portions 435, 440. The end portions 435, 440 include several apertures 445. The apertures 445 are configured to prevent a patient's head from becoming entrapped. Therefore, the apertures are sized to prevent an object having a diameter any greater than 120 millimeters from passing therethrough.

In the illustrated embodiment, the end portions 435, 440 are symmetrical mirror images, but this is not dispositive of other configurations. Referring to the end portion 440, a lower end 450 of the end portion 440 extends lower than a lower extent 455 of the central portion 430. The end portion 440 further includes a siderail end face 460 including an upper end face 465 and a lower end face 470. The upper end face 465 and the lower end face 470 are generally non-collinear, meeting at an intermediate point 475 on the siderail end face 460. The lower end face 470 is configured to be steeper than the upper end face 465, to aid in preventing entrapment. The lower end face 470 preferably forms an angle greater than 60 degrees with the upper surface 175 of the mattress 180.

As shown in FIG. 6, in the raised position the head end siderail 325 extends above the surface 410 of the mattress 180. In this position, the lower extent 455 of the central portion 430 of the siderail 325 extends a distance 480 above the bed frame side rail 125. The lower end 450 of the end portion 440 extends a smaller distance 485 above the bed frame side rail 125. In a preferred embodiment, the distance 480 is no greater than 120 millimeters, while the distance 485 is no greater than 60 millimeters.

A further entrapment danger must be addressed between the lower end face 470 of the siderail 325 and the mattress 180. To obviate this danger, it is recommended that the lower end face 470 describe an angle 487 with the surface 410 of the mattress 180, the angle 487 preferably being greater than 60 degrees.

Figure 7:
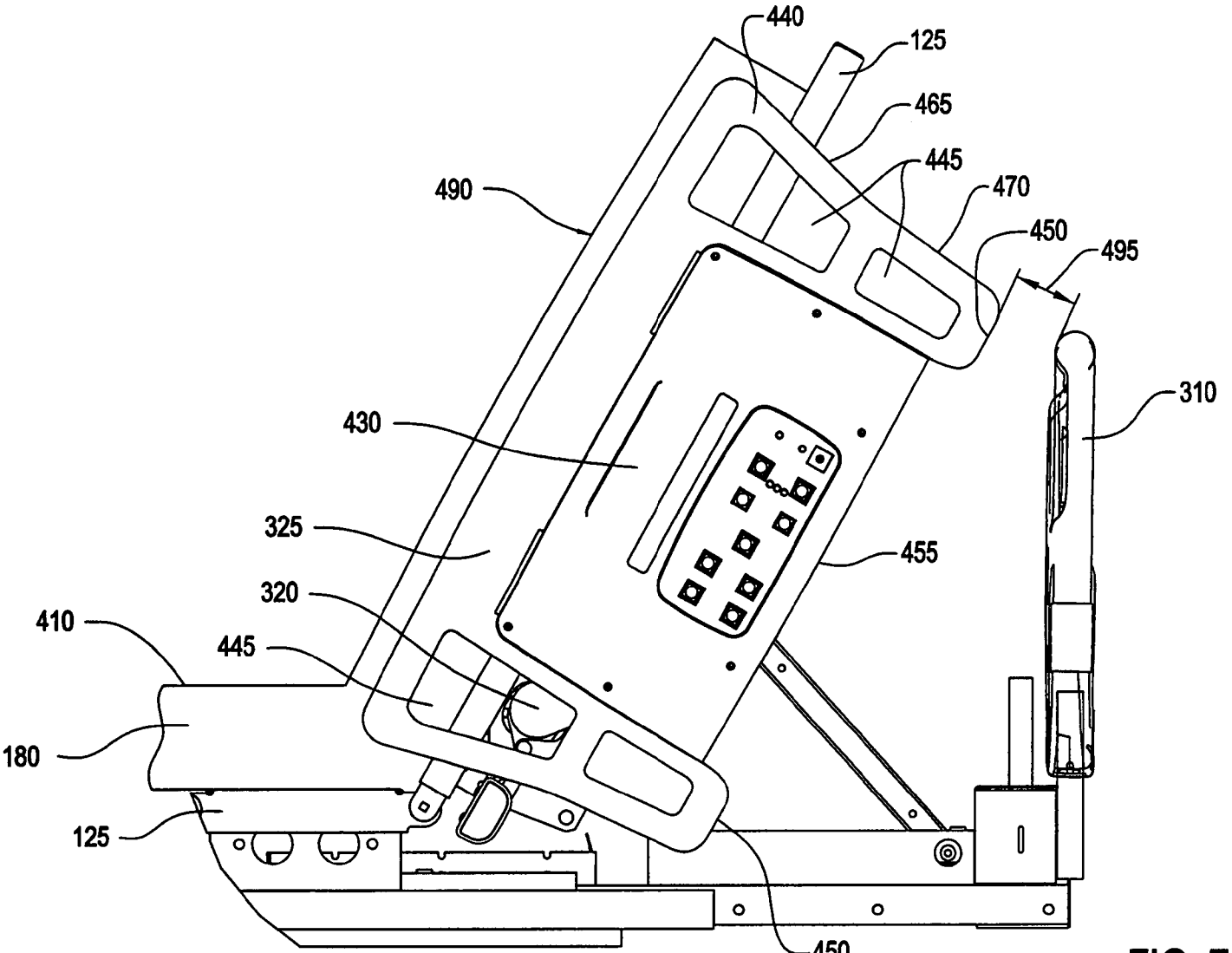
FIG. 7 is a side view of the head end bed siderail and support structure of FIGS. 4 and 6 with the head end of the bed in a raised position.

FIG. 7 illustrates a head section 490 in a raised position. With the head section 490 in the raised position, the head end siderail 325 will occasionally be lowered by rotating about the support arms 320, below the surface 410 of the mattress 180. It is important that a gap 495 between the lowered siderail 325 and the headboard 310 be maintained. The preferred dimension for the gap 495 is less than 8 millimeters or greater than 25 millimeters to avoid presenting a pinch point. In like manner, while the head section 490 is in the raised position, and with the head end siderail 325 in the raised position, a similar gap (not shown) must be maintained between the head end siderail 325 and the foot end siderail 315, also in the raised position; this gap is also preferably smaller than 8 millimeters or greater than 25 millimeters to avoid presenting a pinch point.

Figure 8:
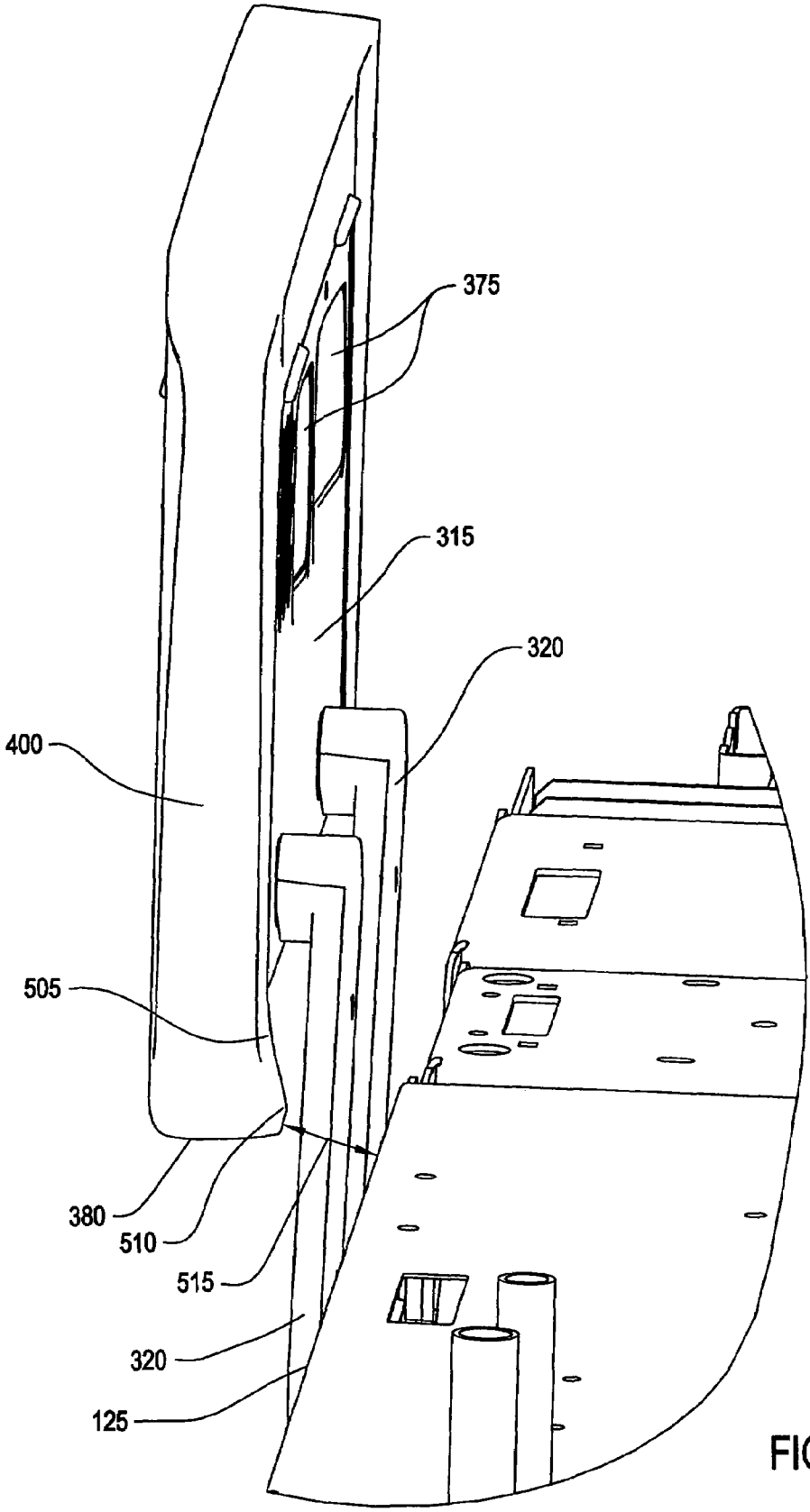
FIG. 8 is an interior view of a bed siderail and support structure according to FIGS. 4-7.

Now referring to FIG. 8, a gap 500 must be maintained between an inner face 505 of the siderail 315 and the bed frame side rail 125. As shown in FIG. 8, the lower end 380 of the end portion 370 of the siderail 315 includes an inwardly extending portion 510. A distance 515 is defined between the inwardly extending portion 510 and the bed frame side rail 125 when the foot end siderail 315 is in the raised position illustrated. The distance 515 must be maintained to minimize a trapping danger to the patient. A preferred dimension for the distance 515 is no less than 60 millimeters. The siderail support mechanism must be sufficiently rigid to maintain the distance 515 of no less than 60 millimeters upon the application of force, such as a patient pressing against the siderail 315.

Figure 9:
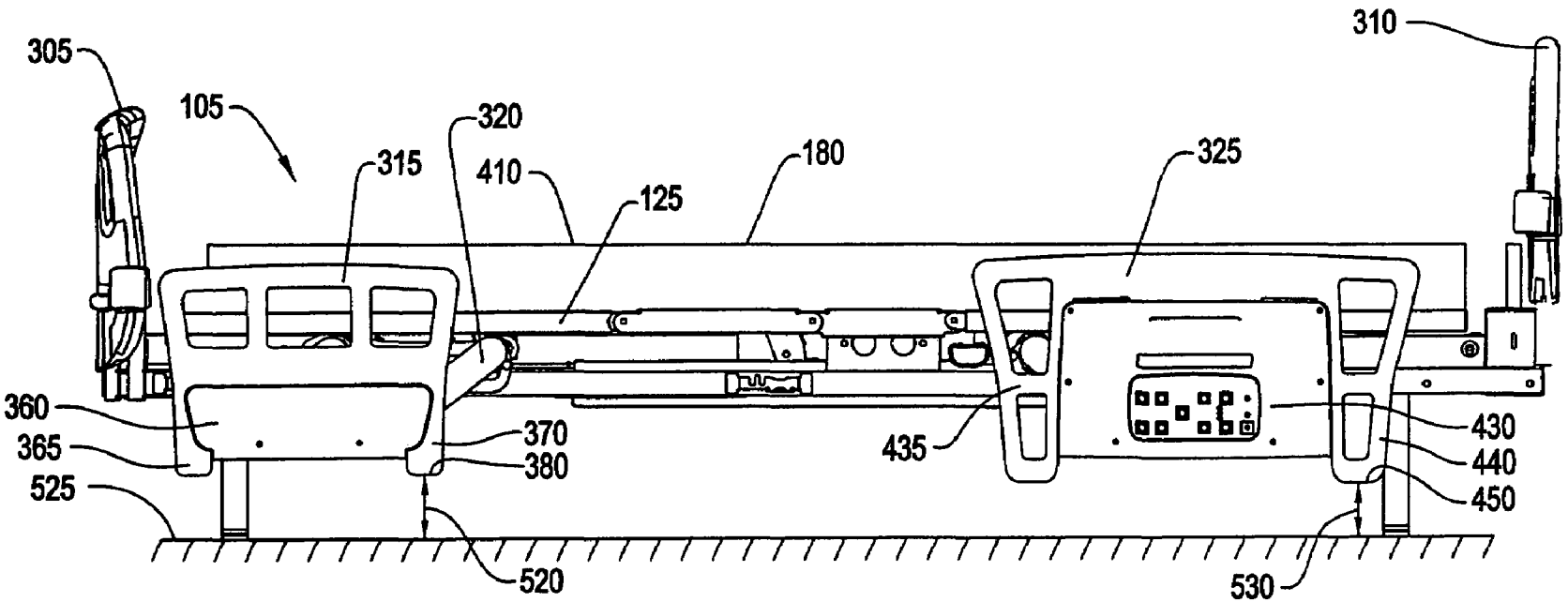
FIG. 9 is a side view of the bed siderails and support structure of FIG. 4, with the bed siderails in a lowered position.

FIG. 9 illustrates the hospital bed 105 with the foot end and head end siderails 315, 325 in the lowered position. With the foot end siderail 315 in the lowered position, the lower end 380 of the end portion 370 is positioned a distance 520 above a floor surface 525 supporting the bed 105. Referring to the head end siderail 325, the lower end 450 of the end portion 440 is positioned a distance 530 above the floor 525. In order to provide foot clearance for an attendant lowering either of the respective siderails 315, 325, each of the distances 515, 530 is preferably no less than 120 millimeters.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the scope of the appended claims.

bed siderail 100
hospital bed 105
central portion 110
end portions 115, 120
bed frame 123
bed frame side rail 125
support arms 130, 135
pivot and locking mechanism 140
end board 150
extension 153
gap 155
depending lower edge 160, 165
lower edge 170
upper surface 175
mattress 180
mattress support 185 (or patient restraint anchor)
bed siderail 200
head and foot edges 205, 210
upwardly and outwardly sloping side surfaces 215, 220, 225, 230
arm covers 240, 245
bed siderail and support structure 300
footboard 305
headboard 310
foot end siderail 315
support arms 320
head end siderail 325
distance 330
foot end gap 335
width 340
inter-siderail gap 345
width 350
head end gap 355
central portion 360
end portions 365, 370
apertures 375
lower end 380
lower extent 385
siderail end face 390
upper end face 395
lower end face 400
intermediate point 405
surface 410
distance 415
distance 420
angle 425
central portion 430
end portions 435, 440
several apertures 445
lower end 450
lower extent 455
end face 460
upper end face 465
lower end face 470
intermediate point 475
distance 480
distance 485
angle 487
head section 490
gap 495
gap 500
inner face 505
inwardly extending portion 510
distance 515
distance 520
floor surface 525
distance 530

What is claimed is

1. A siderail and support mechanism for a bed, comprising: a siderail having a body having a central vertical axis and defining an outer perimeter of the siderail, the outer perimeter defining an upper edge of the siderail, a lower edge of the siderail, a head end edge of the siderail, and a foot end edge of the siderail, the head end edge and the foot end edge having edges extending in a direction from the lower edge of the siderail to the upper edge of the siderail diverging away from the central axis to form diverging angled portions and each of the head end edge and foot end edge being configured to limit the space between the siderail and one of an adjacent siderail and an end board of the bed; a first support arm configured to pivotally attach the siderail to the bed; and a second support arm configured to pivotally attach the siderail to the bed, said support arms for moving said siderail between lowered and raised positions relative to the bed, and each of said support arms including an edge forming a substantially continuous face with the respective head end edge and foot end edge of the body when the siderail is in its raised position.

2. The siderail and support mechanism of claim 1, wherein a distance between a floor surface and a bottom of the siderail in a lowered position is no less than 120 millimeters.

3. The bed siderail and support mechanism of claim 1, wherein the first support arm and the second support arm each further comprises a cover, and each cover includes the edge configured to form the continuous face with the head end edge and the foot end edge of the siderail.

4. The bed siderail and support mechanism of claim 1, wherein the at least one of the first support arm and the second support arm further comprises a cover, and the cover includes the edge configured to form the continuous face with the one of the head end edge and the foot end edge of the siderail.

5. The siderail and support mechanism of claim 1, wherein a diagonal distance between the siderail and one of the end board and an adjacent siderail is less than 8 millimeters.

6. The siderail and support mechanism of claim 1, wherein a diagonal distance between the siderail and one of the end board and an adjacent siderail is greater than 25 millimeters.

7. The siderail and support mechanism of claim 1, wherein a diagonal distance between the bed frame and a bottom of the end of the siderail is no less than 60 millimeters.

8. The siderail and support mechanism of claim 1, wherein each of the head edge and the foot edge of the siderail includes an upper portion and a lower portion, wherein the lower portions are substantially vertical and the upper portions are offset angularly from the lower portion and define the diverging angled portions.

9. The siderail and support mechanism of claim 1, wherein the lower portions extend from the horizontal at an angle no less than 60 degrees.

10. The siderail and support mechanism of claim 9, wherein the upper portions and lower portions of the head edge converge at a point generally midway between the upper and lower edges.

11. The siderail and support mechanism of claim 1, configured for arrangement on a bed so as to cause a gap from the end board of no less than 235 millimeters.

12. The siderail and support mechanism of claim 1, configured for arrangement on a bed so as to cause a gap from the end board of no greater than 60 millimeters.

13. The siderail and support mechanism of claim 1, wherein the siderail comprises a head end siderail, and further comprising a foot end siderail.

14. The siderail and support mechanism of claim 13, wherein the spacing between the head end siderail and the foot end siderail while in a raised position is no greater than 60 millimeters.

15. The siderail and support mechanism of claim 13, wherein the spacing between the head end siderail and the foot end siderail while in a raised position is no less than 235 millimeters.

16. The siderail and support mechanism of claim 1, wherein the siderail further comprises an aperture therethrough, wherein the aperture is configured to prohibit passage of an article having a diameter of 120 millimeters.

17. The siderail and support mechanism of claim 1, wherein the head edge and foot edge of the siderail are configured to cooperate with a frame of the bed to prevent entrapment of a patient.

18. The siderail and support mechanism of claim 17, wherein the clearance between the head edge and the frame of the bed is no greater than 60 millimeters.

19. The siderail and support mechanism of claim 17, wherein the clearance between a central portion of the siderail and the frame of the bed in no greater than 120 millimeters.

20. The siderail and support mechanism of claim 1, wherein the overall height of the siderail is no less than 220 millimeters.

21. A bed siderail and support mechanism comprising:

a siderail for a bed, the siderail having a siderail body with a foot end, a head end, and an outer perimeter for forming a barrier adjacent a bed, the body including a central portion and a perimeter portion extending around the central portion and forming an upper portion of the siderail body above said central portion and first and second end portions, the first and second end portions extending from head end and foot end sides of said central portion respectively and forming the head and foot ends of the siderail body, each of the central portion and the first and second end portions each having a lowermost edge, the lowermost edges of the first and second end portions being configured to extend lower than the lowermost edge of the central portion, the lowermost portion of the outer perimeter of the siderail body being formed by the lowermost edge of the central portion and the lowermost edges of the first and second end portions wherein the first and second end portions are configured to closely cooperate with a bed structure for preventing a patient from being trapped between the siderail and the bed;

a first support arm pivotally mounted to said central portion between said first end portion and said second end portion; and a second support arm pivotally mounted to said central portion between said first end portion and said second end portion.

22. The bed siderail and support mechanism of claim 21, said first support arm having a first upper pivot shaft and a first lower pivot shaft, the first upper pivot shaft configured to pivotally attach to the siderail at a first upper pivot and the first lower pivot shaft configured to pivotally attach to a bed at a first lower pivot, and said second support arm having a second upper pivot shaft and a second lower pivot shaft, the second upper pivot shaft configured to pivotally attach to the siderail at a second upper pivot and the second lower pivot shaft configured to pivotally attach to the bed at a second lower pivot.

* * * * *